US007134901B2

(12) United States Patent
Okura

(10) Patent No.: US 7,134,901 B2
(45) Date of Patent: Nov. 14, 2006

(54) CONNECTOR WITH A MOVING PLATE

(75) Inventor: Yoshio Okura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/302,881

(22) Filed: Dec. 14, 2005

(65) Prior Publication Data

US 2006/0154511 A1 Jul. 13, 2006

(30) Foreign Application Priority Data

Dec. 14, 2004 (JP) ..... 2004-361593

(51) Int. Cl.
*H01R 13/62* (2006.01)
*H01R 13/64* (2006.01)

(52) U.S. Cl. ..... 439/372; 439/140; 439/157

(58) Field of Classification Search ..... 439/140, 439/141, 372, 157
See application file for complete search history.

(56) References Cited

U.S. PATENT DOCUMENTS

| | | | | |
|---|---|---|---|---|
| 4,832,613 A | | 5/1989 | Tsukakoshi | 439/141 |
| 5,501,606 A | * | 3/1996 | Oda et al. | 439/140 |
| 5,558,526 A | | 9/1996 | Nagamine | 439/140 |
| 5,993,255 A | * | 11/1999 | Yurko | 439/595 |
| 6,692,274 B1 | * | 2/2004 | Maegawa | 439/157 |
| 6,848,925 B1 | * | 2/2005 | Nishide | 439/247 |
| 6,896,531 B1 | * | 5/2005 | Bakker et al. | 439/140 |
| 2003/0008537 A1 | | 1/2003 | Nishide | 439/157 |
| 2004/0147158 A1 | | 7/2004 | Hobbs et al. | 439/378 |
| 2005/0059280 A1 | | 3/2005 | Hobbs et al. | 439/140 |

FOREIGN PATENT DOCUMENTS

| | | |
|---|---|---|
| DE | 199 52 023 A1 | 5/2001 |
| JP | 5-12953 | 1/1993 |

* cited by examiner

*Primary Examiner*—Hae Moon Hyeon
(74) *Attorney, Agent, or Firm*—Gerald E. Hespos; Anthony J. Casella

(57) ABSTRACT

A moving plate (50) is movable between a retained position and a released position in a receptacle (35) of a male housing (30). One receiving portion (52) is provided in a middle part of the front surface of the moving plate (50), and a resiliently deformable latch (42) projects from the back surface of the receptacle (35) so that the leading end of the latch (42) is engageable with the receiving portion (52) through an insertion hole (64) of the moving plate (50). Movement of the moving plate (50) from the retained position to the released position is prevented by the resilient engagement of the latch (42) and the receiving portion (52). At the start of the connection of two housings (10, 30), a releasing portion (22) on the front surface of a female housing (10) contacts the latch (42) to disengage the latch (42) from the receiving portion (52).

17 Claims, 11 Drawing Sheets

CONNECTOR WITH A MOVING PLATE

BACKGROUND OF THE INVENTION

1. Field of the Invention

The invention relates to a connector with a moving plate.

2. Description of the Related Art

Japanese Examined Utility Model Publication No. H05-12953 discloses a connector with a male housing that has a receptacle and a moving plate that can move forward and back in the receptacle. The connector also has male terminal fittings with tabs that project forward into the receptacle. Front ends of the tabs are in positioning holes of the moving plate when the moving plate is retained near the open front end of the receptacle. Thus, the front ends of the tabs are positioned vertically and transversely by the moving plate. A female housing pushes the moving plate back towards the rear of the receptacle in the process of fitting the female housing into the receptacle to start the connection of male and female terminal fittings.

Projections on the inner peripheral surface of the receptacle and engage front and rear surfaces of the moving plate at the retained position to prevent forward and backward movements of the moving plate. A connecting force is given to the female housing during connection and must exceed a locking force of the projections. Thus, the moving plate is disengaged from the projections and moves towards the back side of the receptacle.

Locking surfaces of the projections on the inner peripheral surface of the receptacle are oblique to moving directions of the moving plate to define a semi-locking construction. Thus, locking by the projections can be released relatively easily. However, the semi-locking construction creates the possibility that the moving plate will disengage inadvertently from the projections, thereby freeing the leading ends of the tabs before the housings are connected.

The invention was developed in view of the above, and an object thereof is to achieve a highly reliable locking construction for a moving plate.

SUMMARY OF THE INVENTION

The invention relates to a connector with a first housing that has a receptacle. At least one first terminal fitting is mounted in the first housing so that a portion of the first terminal fitting is surrounded at least partly by the receptacle. A moving plate is accommodated at least partly in the receptacle and is movable between first and second positions. The moving plate engages a leading end portion of the terminal fitting when the moving plate is at the first position. However, the moving plate engages a base end of the terminal fitting when the moving plate is in the second position. A second housing is insertable into the receptacle to reach a connected state and pushes the moving plate from the first position substantially to the second position. A receiving portion is provided on a surface of the moving plate and at least one resiliently deformable latch is provided at the receptacle. The latch and the receiving portion engage to prevent movement of the moving plate from the first position to the second position. At least one release is provided on a surface of the second housing for releasing the latch from the receiving portion shortly after the start of the connection of the two housings, thereby permitting the moving plate to move towards the second position.

A retaining force of the latch can be made stronger than the retaining force of the above-described semi-locking construction. Thus, an inadvertent movement of the moving plate from the first position to the second position can be prevented.

The receiving portion preferably is provided in the intermediate part of the mating surface of the moving plate to achieve well-balanced locking between the receiving portion and the latch. Thus, there is no need for plural receiving portions at the peripheral edge of the moving plate.

The latch is released from the receiving portion merely by inserting the second housing into the receptacle. Thus, a latched state by the latch and the receiving portion can be released easily.

The at least one resiliently deformable latch preferably projects from the back surface of the receptacle towards the receiving portion so that the leading end of the latch is close to the mating surface of the moving plate.

The at least one release provided on the second housing preferably contacts a leading end of the latch.

The first housing preferably is a male housing with male terminal fittings. Tabs of the male terminal fittings are surrounded by the receptacle. The second housing preferably is a female housing and can fit into the receptacle to push the moving plate from the retained position to the released position.

The connector further preferably has at least one auxiliary receiving portion at the receptacle, and at least one auxiliary latch for resiliently engaging with the auxiliary receiving portion. A latched state by the auxiliary latching portion and the auxiliary receiving portion is released by pushing the moving plate substantially to the second position.

The at least one auxiliary receiving portion preferably is at the inner peripheral surface of the receptacle, and the at least one auxiliary latch preferably is at a peripheral edge of the moving plate for resiliently engaging the auxiliary receiving portion with the latch disengaged from the receiving portion. Thus, inadvertent movement of the moving plate to the released position can be securely prevented.

The connector also may have at least one error connection preventing portion for permitting connection of the housings when the second housing is in a proper posture while preventing connection of the housings when the second housing is not in the proper posture. The error connection preventing portion preferably projects from the back surface of the receptacle.

At least one insertion hole preferably is formed in the moving plate for permitting the error connection preventing portion to be inserted through the moving plate.

The latch preferably is substantially adjacent the error connection preventing portion and is inserted through the insertion hole together with the error connection preventing portion. Therefore, the latch and the error connection preventing portion can share one insertion hole, and the moving plate can be miniaturized.

The moving plate preferably comprises at least one bulge that closely engages the receptacle to prevent the posture of the moving plate from being inclined forward and backward.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
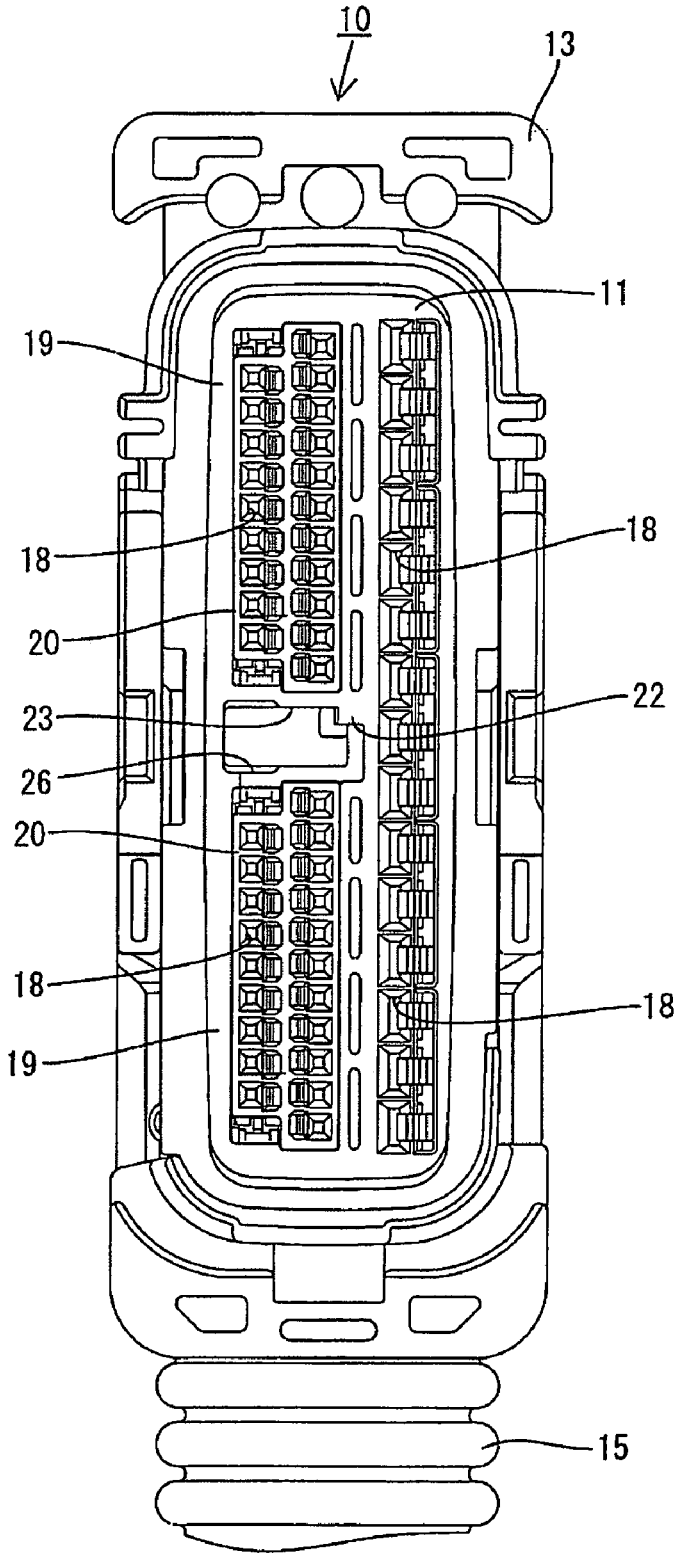
FIG. 1 is a front view of a female housing of a connector according to a first embodiment of the invention.

A connector according to the invention is illustrated in FIGS. 1 to 11 and has a female housing 10 and a male housing 30 connectable with each other along a connecting direction CD. In the following description, ends of the housings 10, 30 to be connected with each other are referred to as the front concerning forward and backward directions FBD, and reference is made to FIG. 1 concerning a vertical direction VD that is substantially normal to the forward and backward directions FBD.

The female housing 10 has a resin main body 11 that is long and narrow in a vertical direction VD. A resilient rubber grommet 12 is mounted from behind to cover substantially all of the main body 11 except the front surface and a resin grommet cover 13 is mounted on the outer side of the grommet 12. A lever 14 is mounted on the outer side of the grommet cover 13 and is operable to assist the connection of the two housings 10, 30.

The grommet 12 has a downward-projecting wire draw-out portion 15 to accommodate bundled wires (not shown) drawn out through the rear surface of the main body 11. The front end of the grommet 12 surrounds the outer periphery of a front part of the main body 11, and engages hooks 16 projecting from the housing main body 11. The grommet 12 can be held in close contact with the male housing 30 to provide sealing between the housings 10, 30 when the housings 10, 30 are connected properly.

The grommet cover 13 is hooked to the hooking projections 16 while the grommet 12 is held between the grommet cover 13 and the main body 11. Two shafts 17 project in an intermediate position of the opposite side surfaces of the grommet cover 13 with respect to the height direction and support the lever 14 pivotaby.

Figure 2:
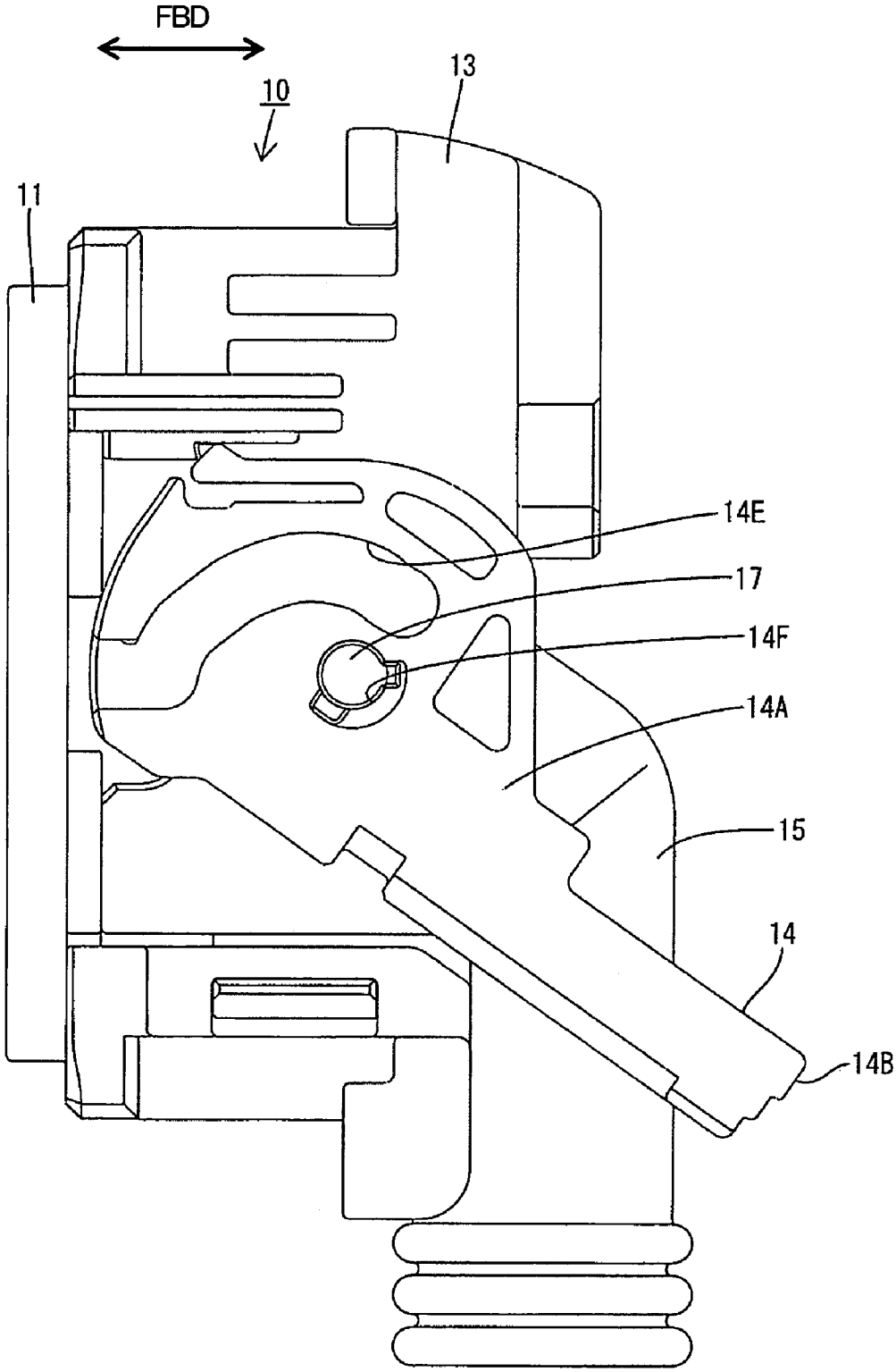
FIG. 2 is a side view of the female housing.

The lever 14 is gate-shaped and has two parallel arms 14A that project from the opposite ends of a coupling portion 14B. As shown in FIG. 2, each arm 14A has a cam groove 14E with an entrance that faces forward towards the male housing 30. The entrances of the cam grooves 14E are dimensioned for receiving follower pins 31 on the male housing 30 at an early stage of connecting the housings 10, 30. The follower pins 31 move along the cam grooves 14E as the lever 14 is rotated and generate a cam action that assists a connecting operation of the housings 10, 30. Each arm 14A has a shaft hole 14F that receives a shaft 17 of the grommet cover 13.

As shown in FIG. 1, cavities 18 are arranged vertically in a row at a right half of the main body 11 when viewed from the front and frame-shaped assembling portions 19 are provided at a left half of the housing main body 11 when viewed from the front. The assembling portions 19 are arranged at upper and lower sides and openings penetrating the assembling portions 19 in forward and backward directions FBD. Block-shaped auxiliary connectors 20 can be inserted into the assembling portions 19. Cavities 18 are formed in each auxiliary connector 20, and female terminal fittings 25 secured to ends of wires 24 are accommodated in the respective cavities 18. A resiliently deformable lock 27 is cantilevered from an inner wall of each cavity 18 for locking the female terminal fitting 25.

An escaping recess 23 is formed in an intermediate part of the front surface of the main body 11 and between the two assembling portions 19 for avoiding the interference with the male housing 30. A releasing portion 22 is provided at an upper right corner of the front edge of the escaping recess 23 when viewed from the front for releasing the moving plate 50 from its retained state. The releasing portion 22 projects towards the escaping recess 23 at the front end of the housing main body 11. The rear surface of the releasing portion 22 is slanted, and a mold-removal hole 21 is formed in the rear surface of the main body 11 at a position corresponding to the releasing portion 22. An error connection preventing groove 26 is formed at the left end of the escaping recess 23 when viewed from front.

Figure 3:
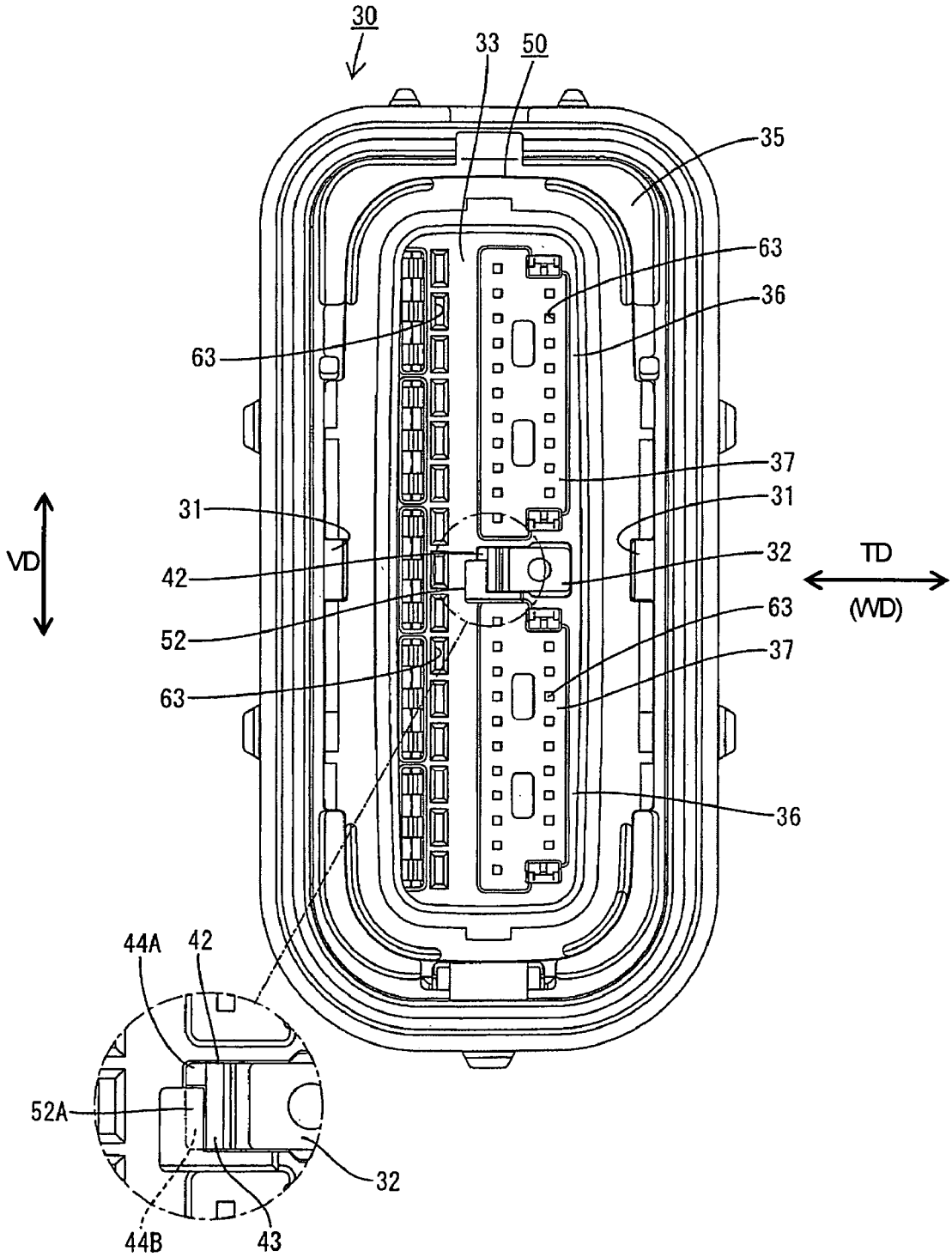
FIG. 3 is a front view of a male housing having a moving plate mounted therein.
Figure 7:
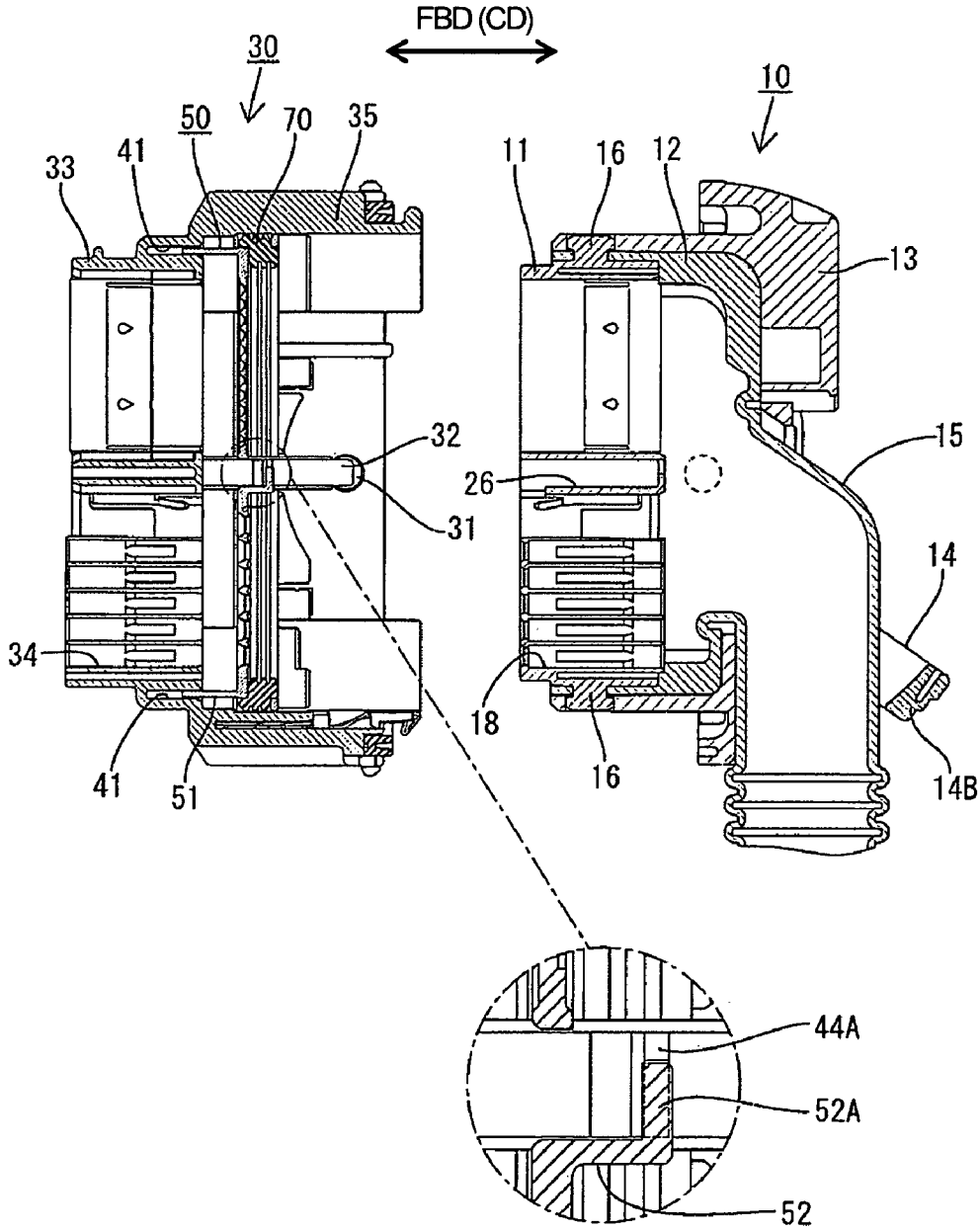
FIG. 7 is a side view in section showing a state before the male and female housings are connected.

The male housing 30 is formed unitarily e.g. of a synthetic resin, and includes a block-shaped terminal accommodating portion 33 that is long and narrow in a vertical direction VD that is substantially normal to the forward and backward directions FBD. The male housing 30 also has a rectangular tubular receptacle 35 with an open front end, as shown in FIGS. 3 and 7. The receptacle 35 is slightly larger than the terminal accommodating portion 33. Cavities 34 are arranged vertically in a row at a left half of the terminal accommodating portion 33, when viewed from the front. The cavities 34 are in positions corresponding to the cavities 18 in the main body 11. Frame-shaped assembling portions 36 are arranged at a right half of the terminal accommodating portion 33 when viewed from the front at upper and lower sides. Openings penetrate the assembling portions 36 in forward and backward directions FBD. Block-shaped auxiliary connectors 37 can be fit into both assembling portions 36, and male terminal fittings 39 secured to ends of wires 38 can be accommodated in cavities 34 formed inside the auxiliary connectors 37. Forward projecting tabs 40 are provided at the leading ends of the male terminal fittings 39, and deformations of the tabs 40 are substantially prevented by the moving plate 50 before the two housings 10, 30 are connected. Resiliently deformable locks 62 are cantilevered from an inner wall of each cavity 34 for locking the male terminal fitting 39. As shown in FIG. 7, two guiding grooves 41 are formed by cutting at the upper and lower ends of the front side of the terminal accommodating portion 33.

An error connection preventing portion 32 is provided on the front surface of the terminal accommodating portion 33 at a position displaced slightly towards one side from the middle. The error connection preventing portion 32 enters the error connection preventing groove 26 of the female housing 10 when the housings 10, 30 are connected in a proper posture. However, the error connection preventing portions 32 contacts the front surface of the female housing 10 to prevent connection when an attempt is made to connect the housings 10, 30 in an improper posture. The error connection preventing portion 32 is a substantially rectangular bar that projects forward from the front surface of the terminal accommodating portion 33 and moves along the error connection preventing groove 26 of the female housing 10 to guide the female housing 10 to a proper connection position.

A latch 42 is cantilevered forward on the left side of the error connection preventing portion 32 when viewed from the front. More particularly, a base end of the latch 42 projects from a substantially middle part of the back surface of the receptacle 35 so that the latch 42 is substantially at the middle of the front surface of the terminal accommodating portion 33. Portions of the latch 42 forward of the base end are resiliently deformable substantially along a transverse direction TD (i.e. the width direction WD) that is substantially normal to the forward and backward directions FBD and the connecting direction CD. The latch 42 is substantially parallel to the error connection preventing portion 32 in its natural state so that a deformation space is defined between the latch 42 and the error connection preventing portion 32. This latch 42 has a main portion 43 that is wide in the vertical direction VD and extends substantially in the forward and backward directions FBD. A latching projection 44 projects out along width direction WD at the free end of the main portion 43. The latching projection 44 prevents the moving plate 50 from moving towards the back side of the receptacle 35, as explained herein.

Figure 9:
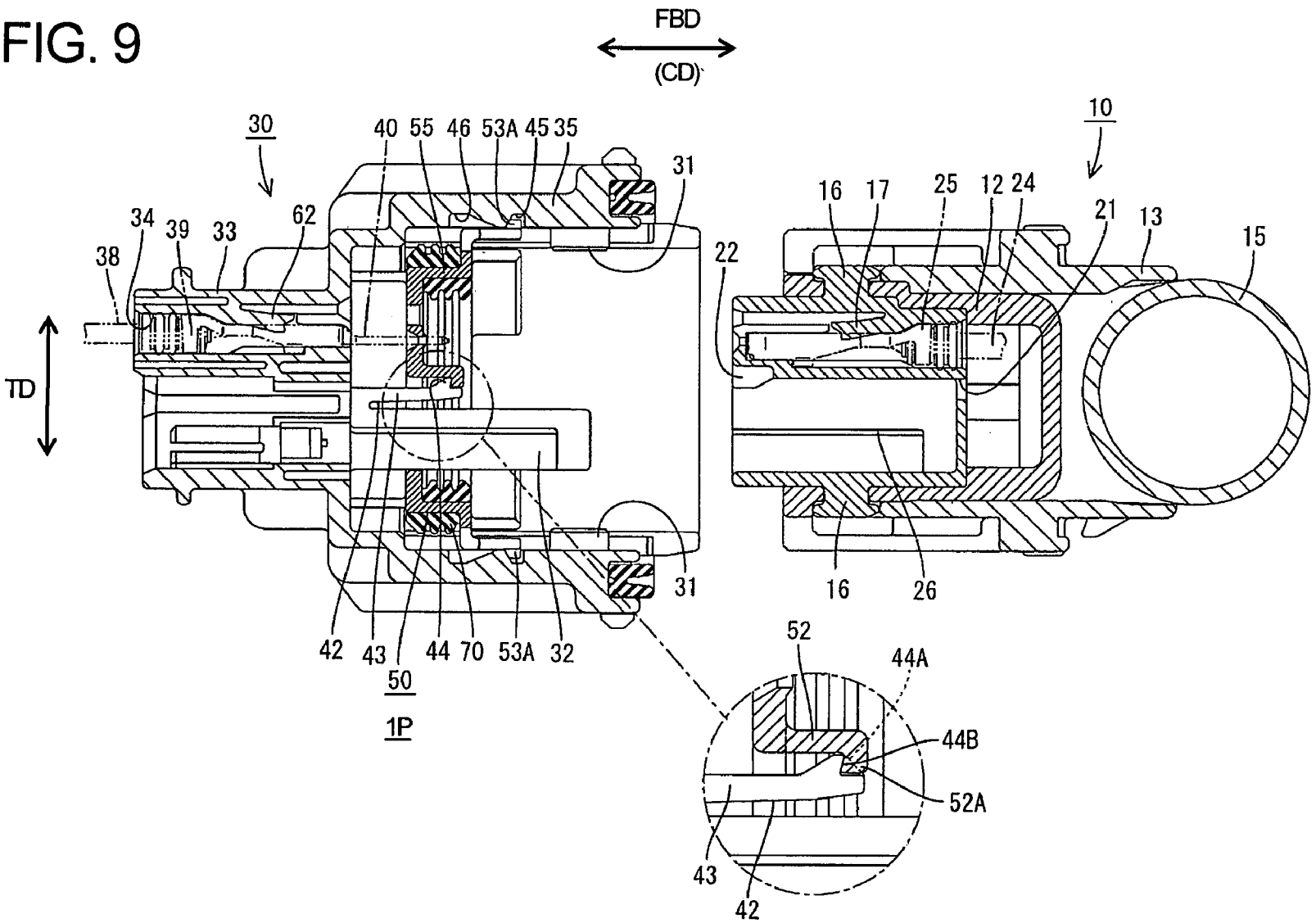
FIG. 9 is a horizontal section showing the state before the male and female housings are connected.

As shown in FIG. 3, the front surface of the latching projection 44 is divided into a latching area 44B and a releasing area 44A that can contact the releasing portion 22. More specifically, the latching area 44B takes up a lower portion (preferably more than about half, more preferably a substantially lower two-thirds area) of the front surface of the latch 42. The releasing area 44A takes up an upper portion (preferably less than about half, more preferably a substantially upper one-third area) of the front surface of the latch 42. As shown in FIG. 9, the latching area 44B of the latching projection 44 is undercut and inclines forward towards the projecting end to achieve an enhanced engaging force. On the other hand, the releasing area 44A of the latching projection 44 is a slanted and inclines back towards the projecting end, and hence with a substantially opposite or complementary inclination. The releasing area 44A contacts the releasing portion 22 at the start of the connection of the two housings 10, 30.

Two follower pins 31 project from the opposed longer inner side surfaces of the receptacle 35 at intermediate positions with respect to height direction. Two first receiving portions 45 are formed substantially symmetrically by recessing positions of the inner side surfaces of the receptacle 35 behind the follower pins 31. The front surfaces of the first receiving portions 45 are substantially vertical and are aligned substantially orthogonal to a connecting direction CD. The rear surfaces of the first receiving portions 45 are slanted and oblique to the connecting direction CD. Two second receiving portions 46 are formed substantially symmetrically by recessing the inner side surfaces of the receptacle 35 behind the first receiving portions 45. The front surfaces of the second receiving portions 46 are slanted and incline moderately to the connecting direction CD. The rear surfaces of the second receiving portions 46 are substantially vertical and are aligned substantially orthogonal to the connecting direction CD.

Figure 4:
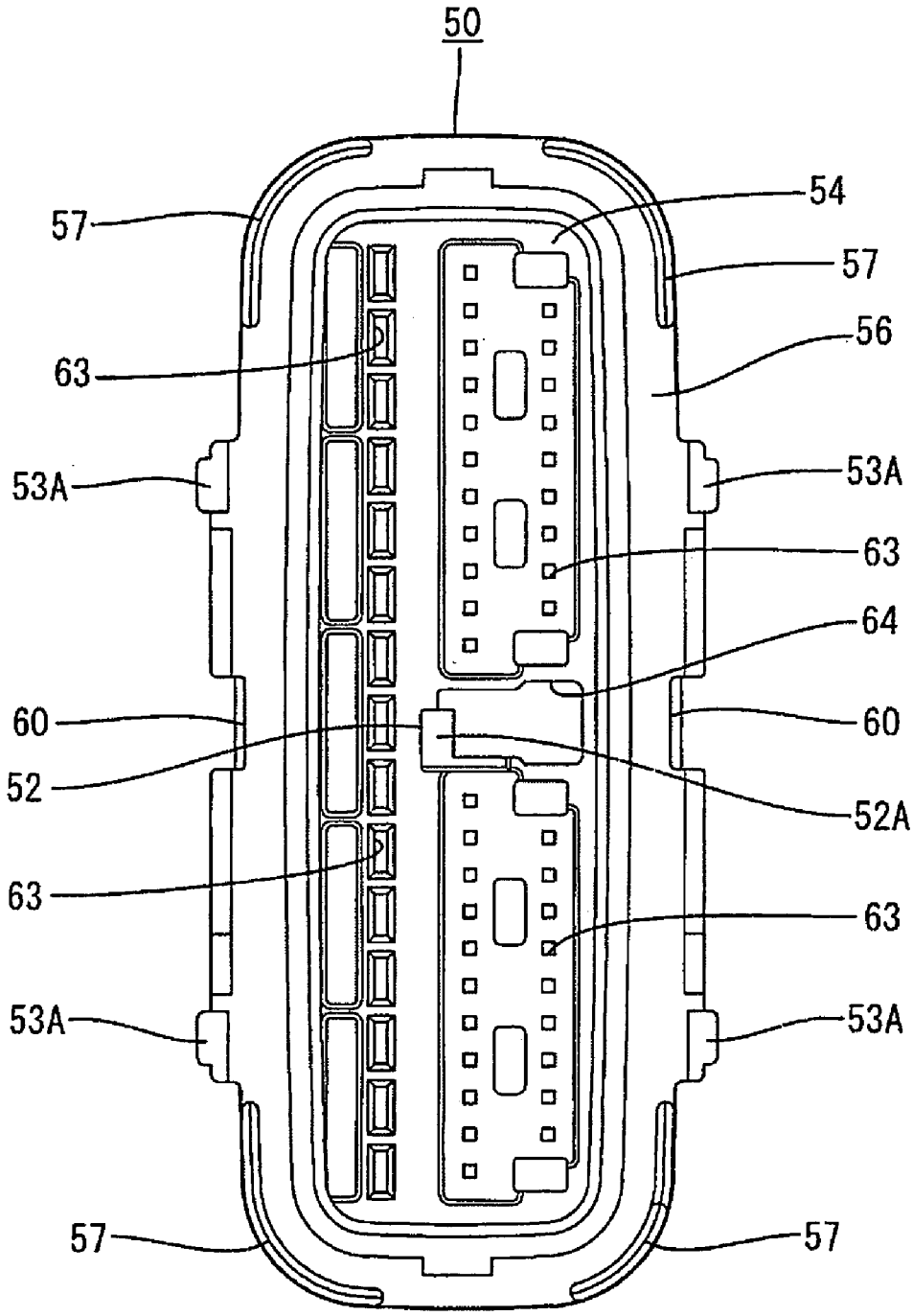
FIG. 4 is a front view of the moving plate.

The moving plate 50 is made e.g. of a synthetic resin and includes a main body 54 in the form of a flat plate that is narrow and long in the vertical direction VD. The main body 54 can fit closely into the receptacle 35 of the male housing 30, as shown in FIG. 4. The moving plate 50 is mounted into the receptacle 35 from the front and is movable along forward and backward directions FBD, i.e. along the connecting direction CD of the two housings, 10, 30 between a retained position 1P (see FIG. 9) at an intermediate disposition along the longitudinal direction of the receptacle 35 and a released position 2P at the back side of the receptacle 35. The front surface of the female housing 10 engages the front surface of the main body 54 of the moving plate 50 as the female housing 10 is fit into the receptacle 35. Thus, the front surface of the female housing 10 pushes the moving plate 50 from the retained position 1P towards the released position 2P.

A side wall 55 projects forward from the peripheral edge of the main body 54 (see FIG. 9), and a flange 56 projects out from the front edge of the side wall 55. Bulges 57 project forward from four corners of the flange 56. The bulges 57 are arcuate and extend forward and backward substantially along the four rounded corners of the flange 56. The bulges 57 closely engage the inner peripheral surface of the receptacle 35 to prevent the moving plate 50 from being inclined. Attaching portions 51 project back from the upper and lower peripheral edges of the rear surface of the main body 54. Both attaching portions 51 are fit into the corresponding guiding grooves 41 of the terminal accommodating portion 33 and move substantially along the guiding grooves 41 when the moving plate 50 is moved. A seal plug 70 is mounted around the attaching portions 51 and contacts the rear surface of the flange 56. The sealing plug 70 closely contacts the inner peripheral surface of the receptacle 35 to provide sealing between the receptacle 35 and the moving plate 50. The outer peripheral surface of the mounted seal plug 70 is substantially flush with the outer peripheral surfaces of the bulges 57.

Figure 5:
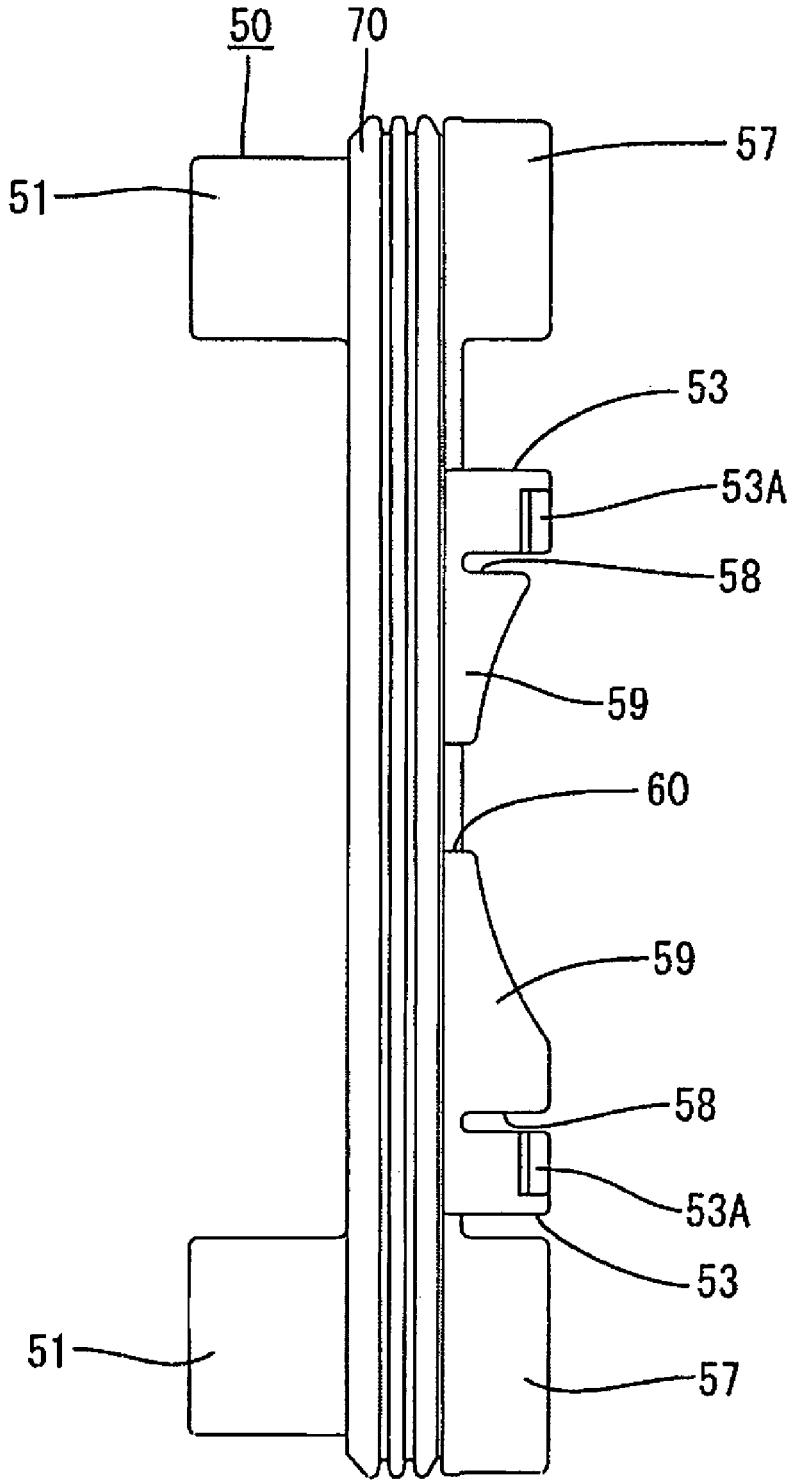
FIG. 5 is a side view of the moving plate.
Figure 6:
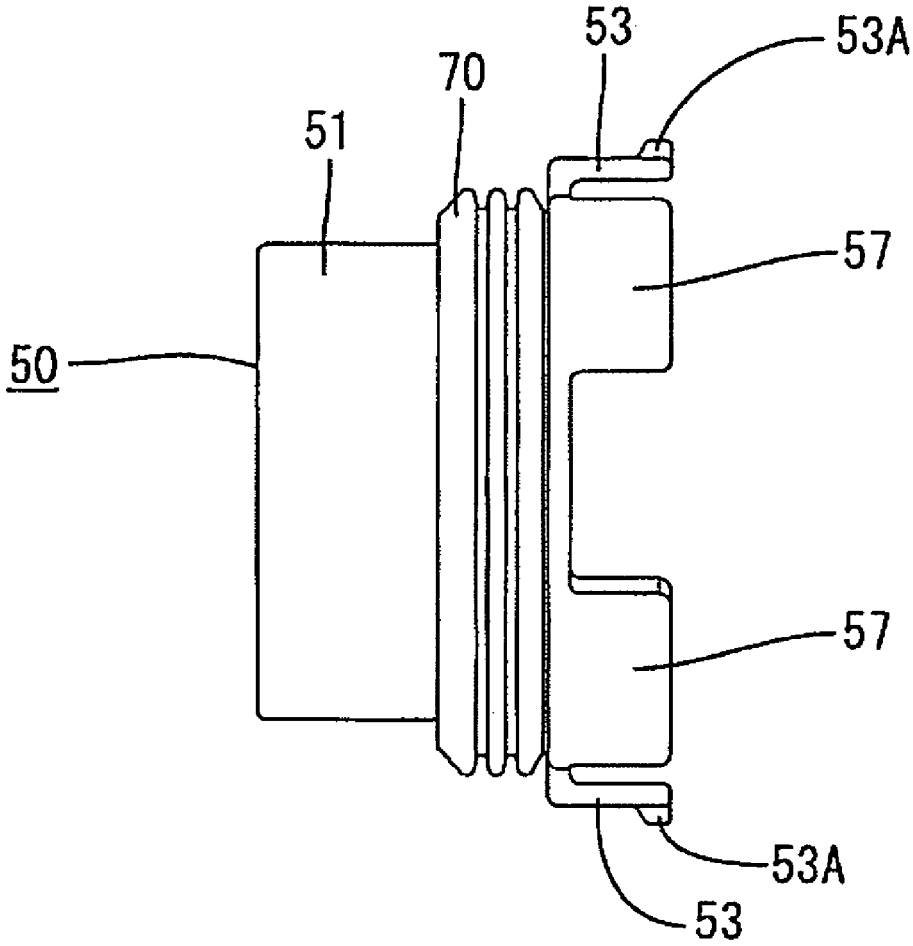
FIG. 6 is a plan view of the moving plate.

As shown in FIG. 5, two upper and lower resilient engaging pieces 53 project forward along the connecting direction CD at each of the opposite longer side edges of the flange 56. A projecting edge 59 projects forward between each pair of upper and lower resilient engaging pieces 53 with slits 58 defined between the resilient engaging pieces 53 and the projecting edge 59. The projecting end of each projecting edge 59 is arcuate and is divided into upper and lower parts by a notch 60 in an intermediate position. The follower pins 31 escape through the notches 60 upon mounting the moving plate 50 into the receptacle 35.

The respective resilient engaging pieces 53 have identical shapes and sizes and are provided at substantially symmetrical positions with respect to the center of connection. The engaging pieces 53 can deform resiliently relative to the opposite lateral edges of the flange 56. Engaging projections 53A project out substantially along width direction WD at the leading ends of the resilient engaging portions 53. The moving plate 50 is held at the retained position 1P by the engagement of the engaging projections 53A with the first receiving portions 45 while being held at the released position 2P by the engagement of the engaging projections 53A with the second receiving portions 46. The rear surfaces of the engaging projections 53A are inclined forward towards the projecting ends. Accordingly, a semi-locking construction is defined by the contact of the slanted surfaces of the engaging projections 53A and the slanted surfaces of the first receiving portions 45. Thus, the female housing 10 can be pushed lightly into the receptacle 35 to move the moving plate 50 to the released position 2P.

Tab insertion holes 63 penetrate the main body 54 in thickness direction and hence along the forward and backward directions FBD and connecting direction CD. The tab insertion holes 63 are at positions corresponding to the respective cavities 34 of the terminal accommodating portion 33. Leading ends of the tabs 40 of the male terminal fittings 30 fit in the tab insertion holes 63 when the moving plate 50 is held at the retained position 1P. Thus, loose movements of the tabs 40 along vertical and transverse directions are substantially restricted. On the other hand, the tab insertion holes 63 are at the base ends of the tabs 40 after the moving plate 50 is moved to the released position 2P and the leading ends of the tabs 40 are connected with the female terminal fittings 25.

The main body 54 also has an insertion hole 64 for permitting insertion of the error connection preventing portion 32 and the latch 42. The insertion hole 64 extends laterally to the right from the intermediate part of the plate main body 54 when viewed from the front. The insertion hole 64 of the main body 54 is shaped and dimensioned so that the error connection preventing portion 32 and the latch 42 just pass therethrough, and the error connection preventing portion 32 inserted through the insertion hole 64 enters the error connection preventing groove 26 of the female housing 10.

The receiving portion 52 is in an intermediate part of the front surface of the main body 54 with respect to the height direction and the width direction WD and projects forward substantially along the bottom edge of the insertion hole 64 from the left edge thereof when viewed from the front. The front edge of the receiving portion 52 is slightly behind the front edge of the side wall 55, and a projecting distance of the receiving portion 52 is substantially equal to a dimension of the releasing portion 22 along forward and backward directions FBD.

As shown in FIGS. 4 and 9, a receiving main portion 52A is provided at the front end of the receiving portion 52 and is substantially rectangular in front view. The receiving main portion 52A is substantially parallel to the front surface of the moving plate 50, and part thereof faces a lower-left side of the insertion hole 64 when viewed from the front. The rear surface of the receiving main portion 52A is undercut and inclines back toward the projecting end. Thus, a strong latching force can be obtained by the contact of the overhanging front surface of the latching area 44B of the latching projection 44 and the overhanging rear surface of the receiving main portion 52A when the moving plate 50 is at the retained position 1P, and the releasing area 44A of the latching projection 44 is exposed above the receiving main portion 52A in the insertion hole 64.

The releasing portion 22 of the female housing 10 contacts and slides along the slant of the releasing area 44A when the female housing 10 enters the receptacle 35. Thus, the latching main portion 43 deforms along the width direction WD and substantially normal to the connecting direction CD. Simultaneously, the latching area 44B of the latching projection 44 disengages from the receiving main portion 52A. The resilient engaging pieces 53 deform resiliently when the female housing 10 is moved farther. Thus, the engaging projections 53A disengage from the first receiving portions 45, and the moving plate 50 starts to move from the retained position 1P to the released position 2P. The resilient engaging pieces 53 are restored resiliently when the moving plate 50 reaches the released position 2P. Thus, the engaging projections 53A engage the second receiving portions 46. Additionally, the latching portion 42 moves over the releasing portion 22 and is restored resiliently to engage the rear surface of the releasing portion 22.

As shown in FIGS. 7 and 9, the moving plate 50 is inserted into the receptacle 35 of the male housing 30 and held at the retained position 1P. The moving plate 50 at the retained position 1P is prevented from coming off backward by the engagement of the engaging projections 53A of the resilient engaging pieces 53 with the first receiving portions 45 and is prevented from making any further forward movement by the engagement of the receiving portion 52 with the latching projection 44 of the latch 42.

Figure 10:
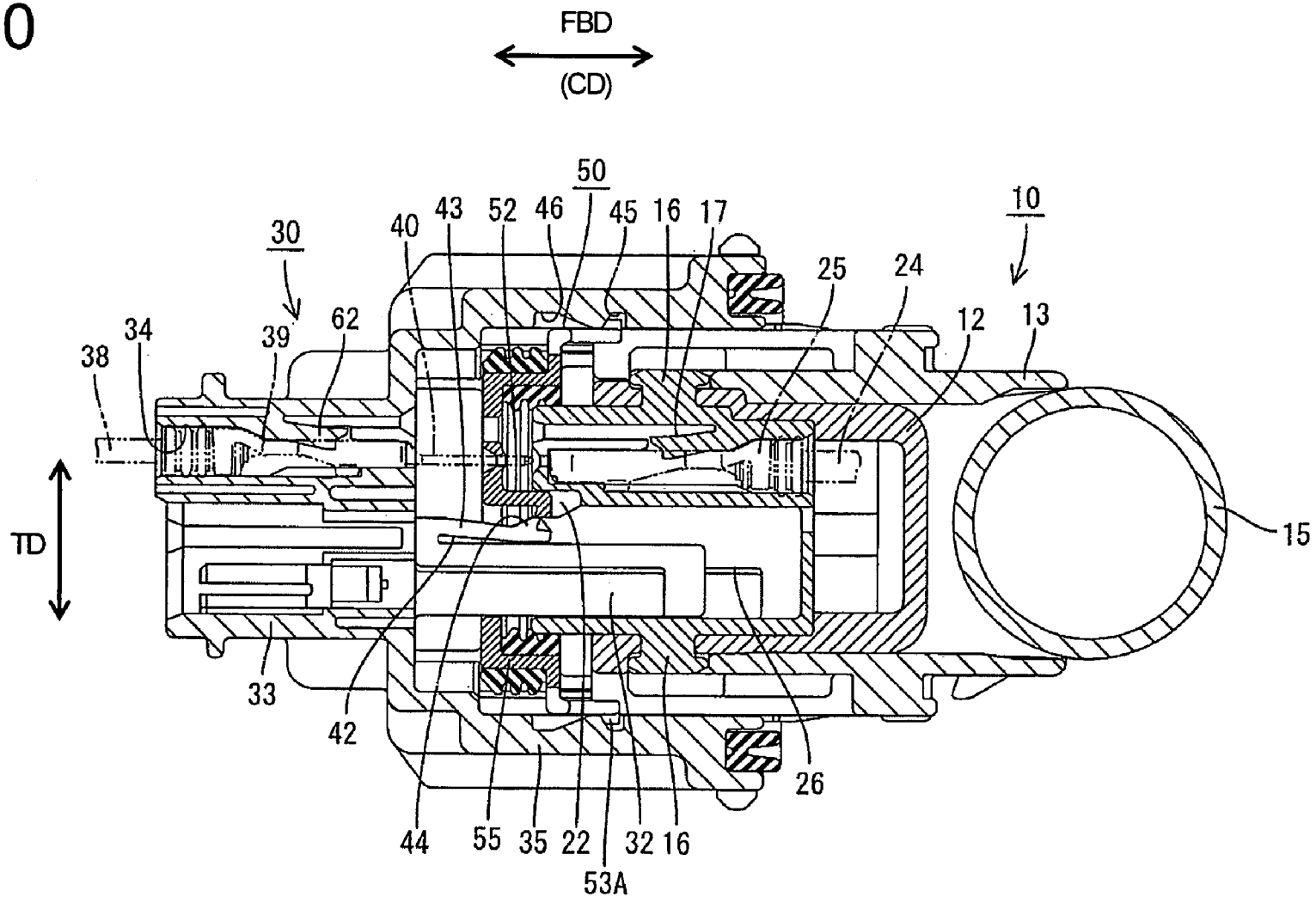
FIG. 10 is a horizontal section showing a state where a latching portion is resiliently deformed upon the start of the connection of the male and female housings.

The female housing 10 then is fit sufficiently into the receptacle 35 of the male housing 30 so that the follower pins 31 are at the entrances of the cam grooves 14E. Accordingly, the front surface of the main body 11 of the female housing 10 is in a space defined by the side wall 55 of the moving plate 50, and the releasing portion 22 of the main body 11 contacts the releasing area 44A of the latching projection 44 exposed at the front surface through the insertion hole 64 of the moving plate 50 and the releasing portion 22 slides along the slant of the releasing area 44A. As a result, the latching main portion 43 deforms resiliently to disengage the latching projection 44 from the receiving portion 52, as shown in FIG. 10.

Figure 8:
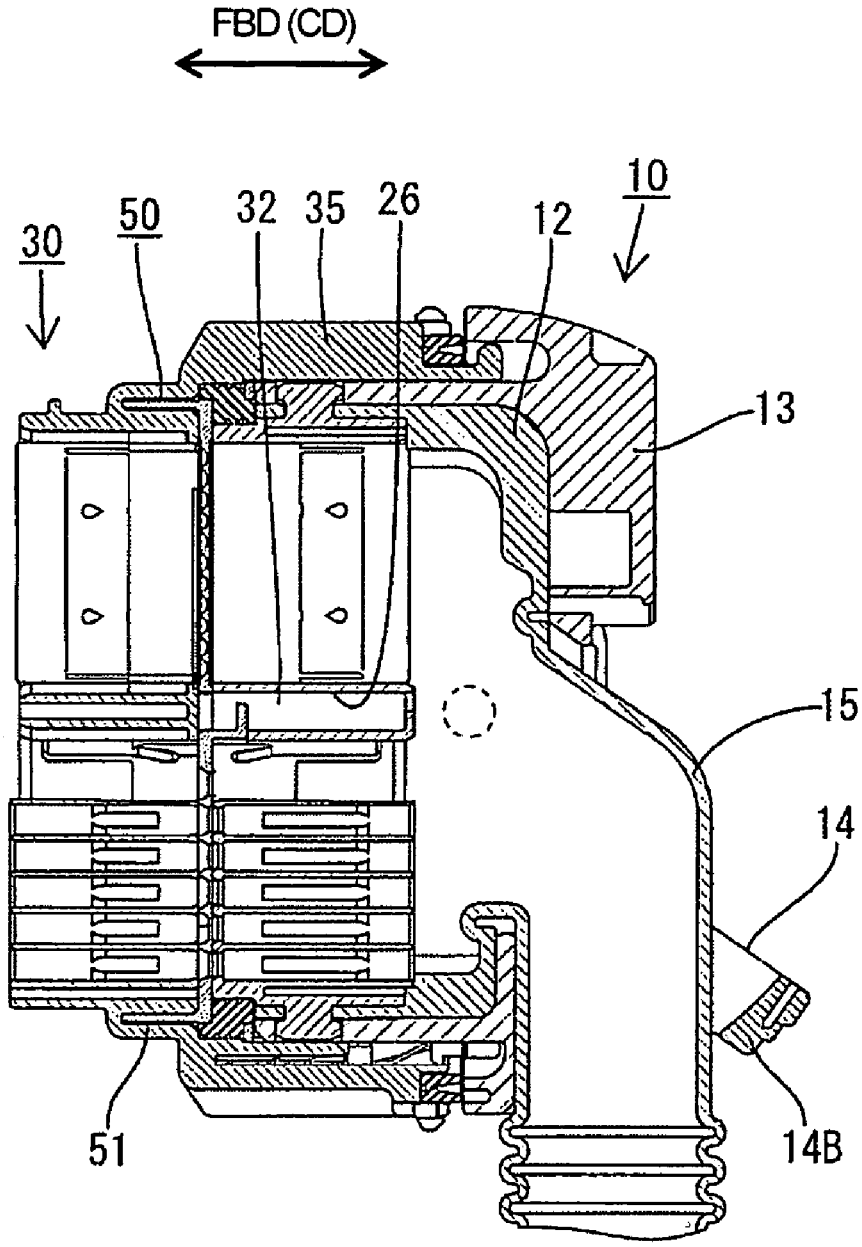
FIG. 8 is a side view in section showing a state where the male and female housings are properly connected.
Figure 11:
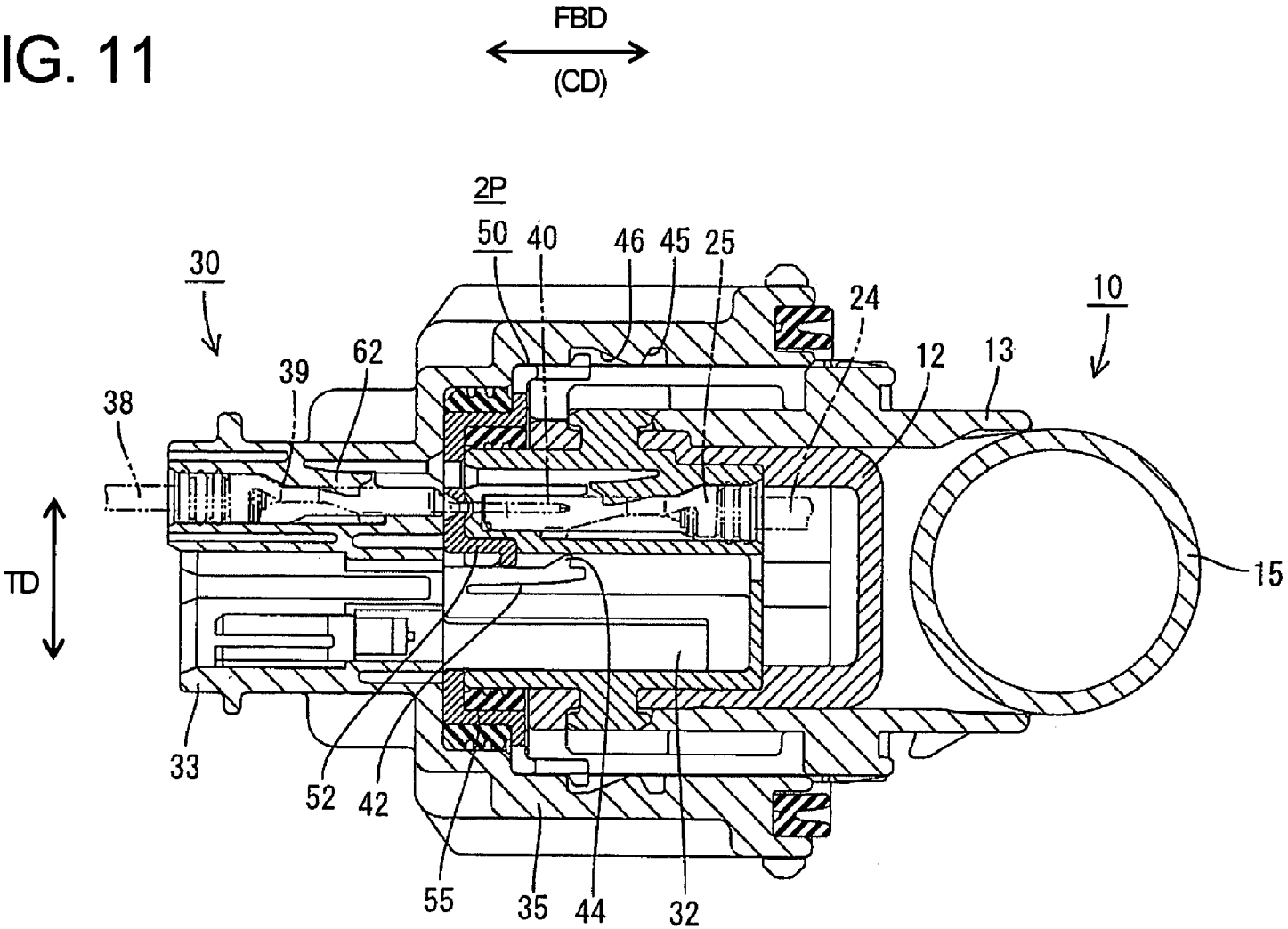
FIG. 11 is a horizontal section showing the state where the male and female housings are properly connected.

The lever 14 on the female housing 10 then can be operated so that the follower pins 31 move along the cam grooves 14E to generate a cam action that helps to move the female housing 10 towards the back side of the receptacle 35. A force for operating the lever 14 exceeds the locking force given by the resilient engaging pieces 53 and the first receiving portions 45. Thus, the resilient engaging pieces 53 and the first receiving portions 45 are disengaged easily from each other at the start of the connecting operation. The two housings 10, 30 are connected properly when the lever 14 reaches an operation end position to connect the male and female terminal fittings 39, 25. Additionally, the resilient engaging pieces 53 are restored resiliently to engage the engaging projections 53A with the second receiving portions 46 and the rear surface of the moving plate 50 faces the back surface of the receptacle 35 as shown in FIGS. 8 and 11. At this time, the leading ends of the attaching portions 51 of the moving plate 50 reach the back ends of the guiding grooves 41 of the terminal accommodating portion 33.

As described above, the latch 42 projects from the back surface of the receptacle 35 and resiliently engages the receiving portion 52 on the moving plate 50 when the moving plate 50 is at the retained position 1P and in engagement with the leading ends of the tabs 40. Thus, the moving plate 50 cannot move towards the released position 2P, and a retaining force is stronger than the retaining force given by a semi-locking construction. As a result, the moving plate 50 cannot move inadvertently from the retained position 1P to the released position 2P before the connection of the two housings 10, 30.

Only one receiving portion 52 is provided in the intermediate position of the front surface of the moving plate 50. Thus, a well-balanced locking construction can be realized in cooperation with the latch 42 even without plural receiving portions 52 at the periphery of the moving plate 50.

The latch 42 contacts the releasing portion 22 on the mating surface of the female housing 10 and is deformed to disengage from the receiving portion 52 as the female housing 10 is fit into the receptacle 35. Thus, the latched state by the latch 42 and the receiving portion 52 is released easily.

The latch 42 is arranged adjacent the error connection preventing portion 32 and passes through the insertion hole 64 in the moving plate 50 together with the error connection preventing portion 32. Thus, the latch 42 and the error connection preventing portion 32 share one insertion hole 64, and the moving plate 50 can be miniaturized effectively using the space.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is applied to a lever-type connector in the foregoing embodiment. However, the invention also is applicable to connectors having no lever. Alternatively, there may be a different type of movable member, such as a slider displaying a cam action for assisting the connection of the two housings and following a substantially linear, arcuate, bent or elliptical path.

The releasing portion of the female housing may contact the latch in the middle part of the front surface of the moving plate to resiliently deform the latch in unlatching direction at the start of the connection of the two housings. For example, if the latch can be resiliently engaged with the edge of the insertion hole, the receiving portion may not project forward.

Although the latch is adjacent to the error connection preventing portion in the foregoing embodiment, the error connection preventing portion may be dispensed with and the moving plate may be formed with an insertion hole for permitting the insertion of the latch.

Although the movable plate is retained in the retained position, it should be understood that the invention is also applicable to movable plates that simply are positioned in the first position as a standby position before the connection of the housings without being actively retained in such position or having its movements prevented only in one direction.

What is claimed is:

1. A connector, comprising:

a first housing (30) having a receptacle (35) and at least one first terminal fitting (39) having a terminal portion (40) surrounded at least partly by the receptacle (35);

a moving plate (50) at least partly accommodated in the receptacle (35) and movable between a first position (1P) where the moving plate (50) engages leading ends of the terminal portions (40) and a second position (2P) where the moving plate (50) engages base ends of the terminal portions (40);

a second housing (10) at least partly fittable into the receptacle (35) and configured for pushing the moving plate (50) from the first position (1P) substantially to the second position (2P);

a receiving portion (52) provided in an intermediate part of a mating surface of the moving plate (50);

at least one resiliently deformable latch (42) in the receptacle (35) and configured to engage the receiving portion (52) for preventing movement of the moving plate (50) from the first position (1P) to the second position (2P); and at least one release (22) on the second housing (10) for deforming the latch (42) out of engagement with the receiving portion (52) substantially as the two housings (30, 10) are being connected for permitting the moving plate (50) to move towards the second position (2P).

2. The connector of claim 1, wherein the latch (42) projects from a back surface of the receptacle (35) substantially towards the receiving portion (52) so that a leading end of the latch (42) is substantially at the mating surface of the moving plate (50).

3. The connector of claim 1, wherein the release (22) on the second housing (10) is engageable with a leading end of the latch (42).

4. The connector of claim 1, further comprising at least one auxiliary receiving portion (45) in the receptacle (35), and at least one auxiliary latch (53) on the moving plate (50) for resiliently engaging the auxiliary receiving portion (45), wherein a latched state by the auxiliary latch (53) and the auxiliary receiving portion (45) is released by pushing the moving plate (50) towards the second position (2P) with the latch (42) disengaged from the receiving portion (52).

5. The connector of claim 4, wherein the at least one auxiliary receiving portion (45) is at an inner peripheral surface of the receptacle (35), and the at least one auxiliary latch (53) is at a peripheral edge of the moving plate (50) for resiliently engaging the auxiliary receiving portion (45).

6. The connector of claim 1, further comprising at least one error connection preventing portion (32) in the receptacle (35) for permitting the connection of the two housings (30, 10) when the second housing (10) is in a substantially proper posture while preventing the connection of the two housings (30, 10) when the second housing (10) is not in the proper posture.

7. The connector of claim 6, wherein the error connection preventing portion (32) projects from a back surface of the receptacle (35).

8. The connector of claim 7, wherein at least one insertion hole (64) is formed in the moving plate (50) for receiving the error connection preventing portion (32).

9. The connector of claim 8, wherein the latch (42) is substantially adjacent the error connection preventing portion (32) and inserted through the insertion hole (64) together with the error connection preventing portion (32).

10. A connector of claim 1, wherein the moving plate (50) comprises at least one bulge (57) configured for closely engaging the receptacle (35) to prevent the moving plate (50) from inclining forward and backward.

11. A connector, comprising:

a male housing (30) having a receptacle (35) and male terminal fittings (39) having tabs (40) surrounded by the receptacle (35);

a moving plate (50) accommodated in the receptacle (35) and movable between a first position (1P) where the moving plate (50) engages leading ends of the tabs (40) and a second position (2P) where the moving plate (50) engages base ends of the tabs (40), a receiving portion (52) provided in an intermediate part of a mating surface of the moving plate (50);

a resiliently deformable latch (42) in the receptacle (35) and configured to engage the receiving portion (52) for preventing movement of the moving plate (50) from the first position (1P) to the second position (2P); and a female housing (10) configured for fitting in the receptacle (35) and for pushing the moving plate (50) from the first position (1P) to the second position (2P), a release (22) on the female housing (10) for deforming the latch (42) out of engagement with the receiving portion (52) as the two housings (30, 10) are being connected for permitting the moving plate (50) to move to the second position (2P).

12. The connector of claim 11, wherein the latch (42) projects from a back surface of the receptacle (35) substantially towards the receiving portion (52) so that a leading end of the latch (42) is substantially at the mating surface of the moving plate (50).

13. The connector of claim 12, further comprising an error connection preventing portion (32) in the receptacle (35) for permitting the connection of the two housings (30, 10) when the second housing (10) is in a proper posture while preventing the connection of the two housings (30, 10) when the second housing (10) is not in the proper posture.

14. The connector of claim 13, wherein the error connection preventing portion (32) projects from a back surface of the receptacle (35).

15. The connector of claim 14, wherein at least one insertion hole (64) is formed in the moving plate (50) for receiving the error connection preventing portion (32).

16. The connector of claim 11, further comprising an auxiliary receiving portion (45) in the receptacle (35), and an auxiliary latch (53) on the moving plate (50) for resiliently engaging the auxiliary receiving portion (45), wherein a latched state by the auxiliary latch (53) and the auxiliary receiving portion (45) is released by pushing the moving plate (50) towards the second position (2P) with the latch (42) disengaged from the receiving portion (52).

17. The connector of claim 16, wherein the auxiliary receiving portion (45) is at an inner peripheral surface of the receptacle (35), and the auxiliary latch (53) is at a peripheral edge of the moving plate (50) for resiliently engaging the auxiliary receiving portion (45).

* * * * *